United States Patent [19]

Rainer et al.

[11] 4,219,031

[45] Aug. 26, 1980

[54] SMOKING PRODUCT HAVING CORE OF FIBRILLAR CARBONIZED MATTER

[75] Inventors: Norman B. Rainer; Donald A. Full, both of Richmond, Va.

[73] Assignee: Philip Morris Incorporated, New York, N.Y.

[21] Appl. No.: 17,483

[22] Filed: Mar. 5, 1979

[51] Int. Cl.[2] ..... A24D 1/04; A24D 3/00

[52] U.S. Cl. ..... 131/10.5; 131/20 R; 131/9

[58] Field of Search ..... 131/10.5, 1, 2, 4 R, 131/8 R, 9 R, 10 R, 10.3, 20

[56] References Cited

U.S. PATENT DOCUMENTS

| | | | |
|---|---|---|---|
| 1,985,840 | 10/1927 | Sadtler | 131/31 |
| 2,907,686 | 12/1954 | Siegel | 131/2 |
| 3,258,015 | 6/1966 | Ellis et al. | 131/8 A |
| 3,349,776 | 10/1967 | Bell et al. | 131/8 R |
| 3,614,956 | 9/1968 | Thornton | 131/10.5 |
| 3,736,941 | 6/1973 | Molins | 131/21 R |
| 3,738,374 | 6/1973 | Bennett | 131/2 |
| 3,738,374 | 6/1973 | Bennett | 131/2 |
| 3,744,496 | 7/1973 | McCarty | 131/8 |
| 3,759,267 | 9/1973 | Thornton | 131/8 R |
| 3,943,941 | 3/1976 | Boyd et al. | 131/2 |
| 3,957,062 | 5/1976 | Labbe et al. | 131/84 B |
| 3,987,804 | 10/1976 | Molins et al. | 131/84 B |

*Primary Examiner*—Stephen C. Pellegrino

[57] ABSTRACT

A smoking product comprising a porous self-supporting central core of carbonized matter circumscribed by tobacco shreds is disclosed. The preferred method for making the core of the smoking product involves the forming of a precursor rod of loosely twisted or substantially non-woven cellulosic material containing additives for ash control, and pyrolyzing said rod by heating in an inert atmosphere to produce a carbonized integral rod consisting of at least about 80 percent carbon. Tobacco shreds and a wrap are applied to the pyrolyzed core to complete the preparation of the smoking product.

17 Claims, 4 Drawing Figures

SMOKING PRODUCT HAVING CORE OF FIBRILLAR CARBONIZED MATTER

FIELD OF THE INVENTION

This invention relates to a smoking article and more particularly to a cigarette having carbonized matter as one element of its construction.

BACKGROUND OF THE INVENTION

Prior art efforts in cigarette making have looked fairly extensively to the use of carbonized matter as a partial or total substitute for the customary tobacco shred content of cigarettes. Viewing such efforts as endeavors to reach equality in smoking experience between carbon-substitute cigarettes and conventional cigarettes as respects resistance to draw, ash-forming and ash-release, applicants herein have concluded that such prior art efforts have fallen short of reaching such equality. Various observations underlie such conclusion of applicants as are now specifically noted.

In the selection of carbonized matter for processing with tobacco, opposed observations apply as to selection of fiber dimension. In blending of tobacco shreds and fine-dimensioned carbon fibers, gravimetric sedimentation in processing lessens initial carbon content in uncontrolled measure giving rise to blend inconsistency. Processing of brittle thin fibers itself leads to the formation of dust-like carbon particles which can either fall out of the blend or agglomerate in the cigarette filter, clogging the filter. Although a graphitization treatment of carbon fibers will overcome their brittleness, this practice incurs a prohibitive cost and still does not fully overcome the above-noted adverse effect of sedimentation. Because the composition of such blends cannot be maintained constant in the course of processing thereof, difficulties are encountered in the recovery and reuse of filler from off-standard cigarettes.

While gravimetric sedimentation of carbon in blend processing is avoided by selection of large-sized carbon fibers, such as may be derived from the carbonization of wood shreds (excelsior) having an average diameter of one millimeter, carbon fibers present in the formed blended cigarette rod having a thickness greater than 0.3 millimeter generate fiery particles which drop freely from the cigarette coal in the course of smoking.

The difficulties attendant on processing a blend of tobacco shreds and carbonized matter, particularly sedimentation, are seemingly avoided by the formation of cigarettes comprised fully of carbonaceous matter. Here, however, it is applicants' observation that prior art practices yield fully carbon smoking products having porosity considerably lower than the porosity of conventional cigarettes. As a consequence, the resistance-to-draw of the rod is excessively high. This category of prior art efforts has the evident further task of attaining flavor without benefit of tobacco content. Further prior art teachings suggest the use of carbonized rod structures comprised of large-sized structural elements which upon burning will generate the aforementioned fiery particles. Such rod structures are also difficult to cut to proper lengths for use in cigarettes.

SUMMARY OF THE INVENTION

It is an object of the present invention to provide improved smoking products of a type containing carbonized material and methods for making such improved smoking products.

In attaining the above and other objects, the invention provides a smoking product which is comprised of a preformed carbonized core circumscribed after such preforming by tobacco shreds and a wrapper. In the preferred making of the smoking product, a loosely twisted or substantially nonwoven cellulosic material is rod-formed and heated sufficiently to pyrolyze the material. A binder and additives to the cellulosic material for control of pyrolysis, ash-forming and ash-release are preferably included prior to such forming and pyrolysis. The thus-formed rod is used as a central core about which tobacco shreds are placed and then wrapped with the core. The resulting smoking product is found to exhibit smoking characteristics comparable to those of conventional cigarettes with lessened delivery of total particulate matter and gas phase components.

In its overall aspect, the invention avoids blend processing and operational limitations arising from fiber dimension selection by separately processing carbonaceous matter and forming its rod therefrom in a self-sustaining manner. This procedure permits usage of small dimension fibers which do not give rise to generation of fiery particles in smoking and variation in batch consistency based on fiber thinness is avoided since the formed rod is of carbonaceous matter without blended tobacco as a constituent.

The foregoing and other objects and features of the invention will be further understood from the following detailed description of preferred practices and embodiments thereof and from the drawings.

DESCRIPTION OF PREFERRED PRACTICES AND EMBODIMENTS

Figure 1:
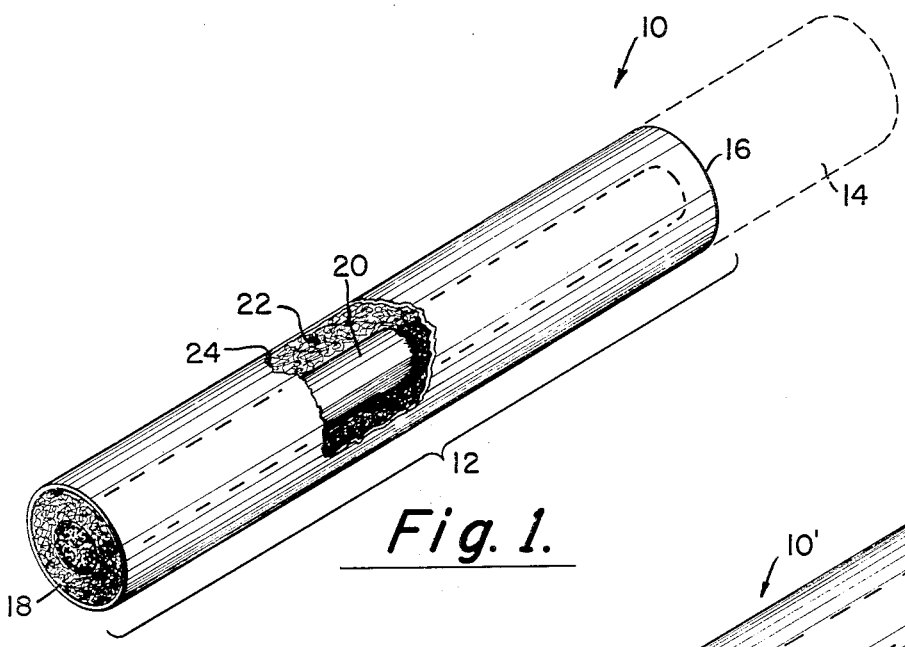
FIGS. 1 and 2 are perspective views of smoking products in accordance with the invention, partly broken away to show interior detail.
Figure 3:
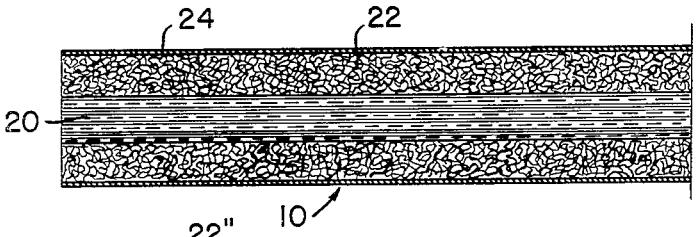
FIG. 3 is a longitudinal sectional view of the smoking product of FIG. 1.

Referring to FIGS. 1 and 3, smoking product 10 is of typical elongate configuration having smoking cylinder 12 and optionally a filter element 14, shown in phantom. Extending fully longitudinally between end faces 16 and 18 of smoking cylinder 12 is central carbonized core 20. Shredded tobacco sleeve 22 circumscribes core 20 and is in turn encircled by wrap 24.

Figure 2:
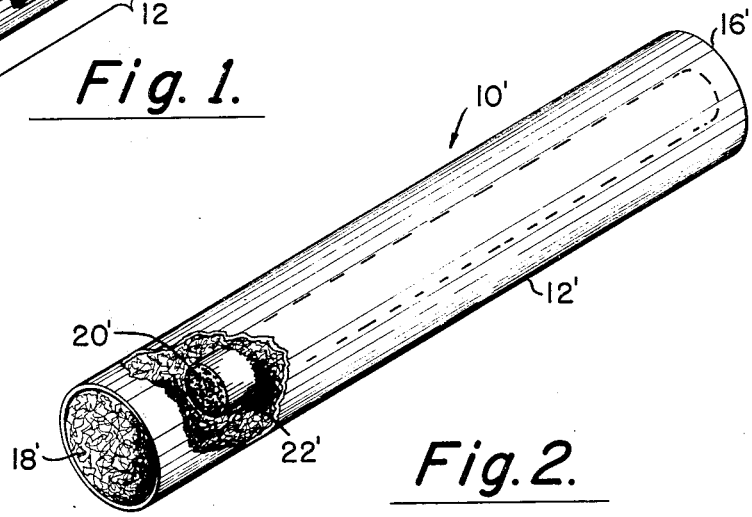

In FIG. 2, smoking product 12' has central carbonized core 20'. Tobacco sleeve 22' circumscribes core 20' and extends axially therebeyond. Core 20' is recessed axially from end face 18', such that the smoking product 10' has the customary appearance of a conventional cigarette when a filter element is applied to end face 16'.

Figure 4:
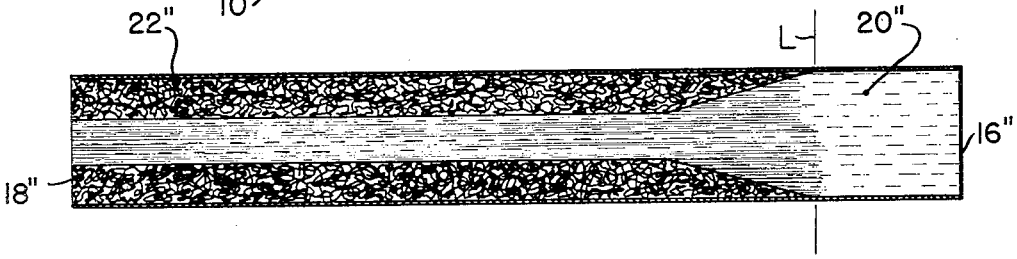
FIG. 4 is a longitudinal sectional view of a further embodiment of a smoking product in accordance with the invention.

In FIG. 4, a still further embodiment of the smoking product has central core 20'' terminating flush with end face 18'' concentrically with tobacco sleeve 22'', but flaring radially outwardly to itself define end face 16''. The core is constituted by carbonized matter from end face 18'' to location L, as achieved such as by pyrolysis of core-forming matter to location L, and is formed of unpyrolyzed core-forming matter from location L to end face 16'' and serving as an integral filter for the smoking product.

Particularly preferred carbonized cores are produced from cellulose rods made by passing a continuous web structure into a forming cone that laterally gathers and compresses the web into a bundled cylindrical form. The cross-sectional configuration of such rods, shown in FIGS. 3 and 4, may be characterized by the presence of random folds, running generally parallel to the rod axis. Such rods are further distinguished by the fact that a portion of the individual fibers that constitute the structure are aligned in directions transverse to the longitudinal axis of the rod. Suitable web structures include papers, fabrics, and textile-like, non-woven webs made from cotton, wood pulp, and other fine-dimensioned fibrous cellulosic substances. An isotropic orientation of the filaments in the plane of the web is generally preferable. Suitable papers may be creped or smooth and have weights from about 5 to 40 grams per square meter. Bundled and untwisted cellulosic strands or rods may be provided with a wrapper to maintain strand integrity prior to and/or during the carbonization treatment. An example of suitable cellulosic rod is the crimped and bundled paper rod manufactured for use in cigarette filters.

Paper derived from wood pulp is the preferred cellulosic material, particularly in view of its low cost and the fine dimensions of the individual cellulosic particles which constitute the paper structure. Prior to forming the paper into a strand, the paper may be treated with processing aids such as water, lubricants, or softening agents that make the paper more supple and amenable to a gathering or bundling operation to form the strand structure. The processing aids will generally be removed during carbonization. Other additives may be incorporated into the cellulosic material to control the manner of carbonization or to impart special combustion properties to the carbon rod product. Additives of particular interest are water-soluble salts, especially calcium compounds that modify combustion characteristics.

The resultant carbonized rod may, in fact, contain 20–50 percent by weight of ash-forming materials. Binding agents may be applied to the cellulosic strand to improve shape retention prior to and during carbonization and to increase the strength of the carbonized rod. Certain binding agents may be converted to carbon during the carbonization treatment. An example of one such suitable binding agent is polyfufuryl alcohol which is transformed to carbon during the pyrolysis treatment.

The pyrolysis may be carried out by drawing the cellulosic strand through a heated die in an oxygen-free environment. The die subjects the cellulosic material to a temperature in the range of 600–1000° C. for a period of time sufficient to cause a weight loss of 60–85 percent of the initial cellulosic material. The duration of heating may vary from a fraction of a second to about 45 seconds depending on the diameter of the strand, its degree of compaction, the temperature of the die, the nature of the cellulose and its additives (if any), and other factors. The pyrolyzate tar that forms during carbonization may be removed from the vicinity of the die by means of an inert sweep gas such as nitrogen. Pyrolyzate tar which deposits within the rod undergoes separate carbonization depositing film-like carbonaceous material serving as a bonding agent for the fibrillar structure. In the course of the carbonization treatment, considerable shrinkage is obtained which has a further strengthening effect on the rod structure.

The oxygen-free environment may be provided by the gaseous products of pyrolysis. Such gaseous mixture may in fact be drawn off as it forms and recovered for its fuel value.

The primary function of the die is to obtain a precise outer periphery of the carbon rod. The die may be of any reasonable length. In general, a tapered die is preferred in order to achieve controlled compaction of the entering strand as it undergoes carbonization. Carbonized cores of non-circular cross-section may be produced from appropriately shaped dies.

Other methods may be employed for carbonizing the strand of fibrous cellulosic material. For example, the strand may be formed into a shape-retaining structure and then carbonized in a conventional oven. Duration of heat treatment in an oven may range from several minutes to about an hour. The strand may also be shaped and/or carbonized by means of pressing between heated platens or by means of suitably grooved heated rollers or belts.

As employed in the present invention, the term "carbonization" is intended to describe the conversion of cellulose to a substance that, by elemental analysis, consists of at least 80 percent carbon exclusive of ash-forming ingredients. Following its formation, the carbon rod may optionally be subjected to an activation treatment by partial oxidative erosion at temperatures in the range of 750°– 1050° C. The activation produces a high surface area which is capable of selectively adsorbing certain smoke components.

Catalytic species, such as active metals and metal oxides, metal salts and other agents to modify burning characteristics and smoke composition, can be incorporated into the carbon core by application either prior to or after carbonization. Flavoring agents or other ingredients may be applied to the core by spraying, dipping, or other known methods to enhance its smoking characteristics.

The diameter of the carbonized rod should be greater than about 3 mm in order to insure that the rod structure has adequate physical strength to facilitate subsequent fabrication into smoking articles and also to provide a significant reduction in the particulate delivery of the smoke of the cigarette. The diameter of the rod should not exceed about 6.5 mm. It is desirable to have a surrounding layer of cut tobacco about the carbon core of at least 1.5 mm in depth and preferably at least 2 mm in depth. The ratio of the diameter of the carbon core to the diameter of the smoking article should be between 0.30 and 0.75.

The nature of the porosity of the carbonized rod is such that the rod contains greater than 60 percent and preferably greater than 80 percent volume of interconnecting void space as measured by the method of Hartung and Dwyer reported in Paper #10 of the Tobacco Chemists Research Conference, October, 1974. The percentage of open volume within a carbonized rod may also be ascertained by determining the volume of solid material within the rod using an air pycnometer and comparing this value with the total or envelope volume of the rod structure.

The flexural strength of the carbonized rod should be adequate to facilitate machine handling in the production of cigarettes. For the purposes of this invention, it has been found expedient to measure the flexural strength by horizontally supporting a specimen at two points located 36.5 mm apart and determining the amount of downwardly applied force needed to break the rod at the center of its span. An Instron Tensile Tester (made by the Instron Engineering Corp., Canton, MA) coupled to a strip chart recorder was utilized to determine the applied force. The rate of downward movement of the force-applying member is 5 cm/min., and the chart speed in 10 cm/min. When measured in this manner, it is found that, in order to possess adequate strength for use in cigarette fabrication, the carbon rod should possess a flexural strength greater than 4 grams and preferably greater than 10 grams.

The carbonized rods are utilized in the manufacture of cigarettes by feeding the rods into cigarette fabricating equipment which arranges cut tobacco shreds around the periphery of the core. The feeding of the carbonized core to the cigarette fabricating machine may be on a continuous or discontinuous basis. The core may extend the entire length of the combustible portion of the cigarette, or it may terminate short of the end so that the appearance of the cigarette end will not reveal its presence. In comparison with ordinary cigarettes of equal dimensions and construction but without an internal carbon core, the cigarettes of this invention contain at least 30 percent by weight less tobacco, deliver at least 10 percent less particulate matter, and have essentially the same RTD.

The particulate matter of tobacco smoke consists of minute liquid particles condensed from the vapor formed by the combustion of the cigarette and suspended in the smoke stream. These particles are collectively referred to as the total particulate matter, which for convenience may be referred to as TPM. The TPM content of smoke is measured by determining the weight of material trapped on a Cambridge filter pad under standard machine-smoking conditions.

RTD is determined as follows. A vacuum system is set to pull an air flow of 1050 cc/minute by inserting a standard capillary tube through the dental dam of a cigarette holder and adjusting the reading on an inclined water manometer to the correct RTD. Then the butt end of a cigarette is inserted to a depth of 5 mm in the dental dam of the cigarette holder. The pressure drop behind this cigarette with 1050 cc/minute of air flowing through is read directly as RTD in inches of water.

The following examples are illustrative.

EXAMPLE 1

Cellulosic rods manufactured by the Honshu Company of Japan were employed. They had a rod diameter of 8 mm, a length of 100 mm, and consisted of non-woven sheets of cotton linters; the sheets being laterally crimped and bundled to form the rod structure. The rods were treated with a solution consisting of 1 percent $K_2SO_4$ and 1 per cent calcium acetate obtaining a 100 percent add-on of said solution prior to pyrolysis. Pyrolysis was accomplished by heating the rod structures in a glass tube at 600° C. with a stream of nitrogen flowing through the tube. When cessation of evolution of pyrolysis products was observed, the pyrolysis treatment was terminated and a cooling flow of nitrogen was passed through the tube. The resultant carbonized rod structure was found to have undergone a weight loss of 75 percent. It contained an open pore volume of 63 percent, had a flexural strength of 8.3 g, and had a diameter of 3.3 mm. The weight of 80 mm lengths of the carbonized rods averaged 0.0623 g.

The carbonized rods were utilized as the center core for the production of cigarettes of 8 mm diameter utilizing an average of 0.4913 g of cut blended tobacco to surround the carbonized core. The average RTD of the cigarettes prepared in this manner was 5.1 inches water including the 15 mm length of conventional cellulose acetate filter attached to one end of the cigarette.

The resultant cigarettes were found to provide a 15 per cent reduction in TPM delivery in comparison with a control cigarette made in identical manner except for omission of the carbonized core and the presence, in its place, of cut blended tobacco. When smoked by a panel of experts, the core-type cigarette of this example was found to be not significantly different from the control cigarette with respect to taste level and was milder and more preferable. In the course of smoking, no fiery particles were observed to fall from the glowing cigarette coal, and the appearance of the ash of the cigarette was such that it was essentially indistinguishable from the ash of the control cigarette.

EXAMPLE 2

Cylindrical rods comprised of bundled perforated crepe paper having a basis weight of 25 g/m$^2$ and made from highly bleached coniferous kraft wood pulp containing about 85 percent alpha cellulose were employed for the production of carbonized core. The paper rods, wrapped with a thin flax paper, had a diameter of 8 mm and a density such that a 90 mm length weighed 1.03 g. The bundled nature of the rod was such that numerous folds were present extending in the direction of the longitudinal axis of the rod.

Carbonization was accomplished by heating the cellulose rod in a tightly filling glass tube at 750° C. with a stream of nitrogen flowing through the tube. When cessation of evolution of pyrolysis products was observed, about 10 percent stream was added to the nitrogen flow to produce an activated carbon. The resultant carbonized rod structure was found to have undergone a weight loss of 85 percent. It contained an open pore volume of 69 percent and a flexural strength of 4.6 g. Its diameter was 3.6 mm.

The carbonized rods were utilized as the center core for the production of cigarettes of 8 mm diameter and 85 mm length containing about 0.48 g of cut blended tobacco to surround the core. The average RTD of the cigarette prepared in this manner was 5.3 inches water including the 15 mm length of conventional cellulose acetate filter attached to one end of the cigarette.

The resultant cigarettes were found to provide a 19 percent reduction in TPM delivery in comparison with a control cigarette made in an identical manner except for omission of the carbonized core and the presence, in its place, of cut blended tobacco. When smoked by a panel of experienced smokers, the cigarette of this example was adjudged to be slightly milder yet just as flavorful as the control cigarette. In the course of smoking, no fiery particles were observed to fall from the flowing coal, and the appearance of the ash was essentially indistinguishable from that of the control cigarette.

A number of the core-containing cigarettes of this example were subjected to a slitting and recovery operation using vibrating screens to separate the cut tobacco from the other cigarette components. It was found that the tobacco could, in this manner, be separated from the core for subsequent re-use in cigarette fabrication.

EXAMPLE 3

A bundled cellulose rod similar to that of Example 2 was fabricated from perforated crepe paper consisting of 60 percent flax pulp and 40 percent cotton linters.

Carbonization of the rod was achieved by feeding a continuous length of the rod into a heated ceramic die having a conical internal configuration tapering from 8 mm diameter at the entrance to 3.5 mm diameter at the exit, the length of the die being 5 cm. The die was maintained at a temperature of 780° C. and was enclosed in a chamber fed by a stream of nitrogen at a rate sufficient to sweep volatile products out of the chamber.

The resultant carbonized structure was cut into 85 mm length rods. It had undergone a weight loss of 71 percent, contained an open pore volume of 74 percent, and possessed a flexural strength of 6.2 g.

The carbonized rods were utilized as the center core for the production of machine-made cigarettes of 8.5 mm diameter and 85 mm length using about 0.55 g of cut blended tobacco to surround the core. The average RTD of the cigarettes prepared in this manner was 5.3 inches of water including the 15 mm length of conventional cellulose acetate filter attached to one end of the cigarette.

The resultant cigarettes were found to provide a 21 percent reduction in TPM delivery in comparison with a control cigarette made in an identical manner except for omission of the carbonized core and the presence, in its place, of cut blended tobacco. When smoked by a panel of experts, it was found that the core-type cigarette of this example was milder than the control cigarette but was considered to have acceptable taste. In the course of smoking, no fiery particles were observed to fall from the glowing cigarette coal, and the appearance of the ash was such that it was essentially indistinguishable from the ash of the control cigarette.

EXAMPLE 4

Carbonized cores were made by pyrolyzing cigarette filter rods of 8 mm diameter and 80 mm length (Honshu AKG-1 Neofilter) made from crimped and bundled non-woven sheets of purified wood pulp. The filter rods were placed in close-fitting glass tubes for the pyrolysis process. Heating was accomplished by heating the outside of the tube with a Bunsen burner, and nitrogen gas was passed through the tube during the pyrolysis and subsequent cooling.

The average weight of the core thus produced was 51.3 mg. It had a 5 mm diameter and possessed adequate strength to be handled for the making of handmade cigarettes.

Cigarettes were made on a RYO Filtermatic Cigaret Maker (Sutliff Tobacco Co., Richmond, Va.) by surrounding each core with 600 mg of tobacco filler; then rolling, sealing, and combining with a 15 mm cellulose acetate filter rod. The overall RTD of the cigarettes thus made averaged 4.5 inches of water.

As a control sample, cigarettes were similarly made on a RYO unit using the same tobacco filler but omitting the carbonized core and using, in its place, the same tobacco filler. On said control cigarettes, 830 mg of filler had to be utilized to obtain firm cigarettes having the same 4.5 inches of water RTD as the above-described core-containing cigarettes.

The cigarettes were then smoke tested to determine the delivery of TPM and various gas-phase components. The results are presented below on a per puff basis and expressed as the ratio between the test and control cigarettes for purposes of better comparison.

| Test or Characteristic | Results Core/Control |
|---|---|
| Total Filler Weight | 0.784 |
| Tobacco Content | 0.722 |
| TPM | 0.769 |
| CO | 0.730 |
| $CO_2$ | 0.989 |
| HCN | 0.790 |
| $NO_x$ | 0.839 |

The data indicated that the presence of the core reduces the amounts of TPM, carbon monoxide, and other smoke components to a degree essentially proportional to the amount of tobacco replaced.

EXAMPLE 5

Cigarette filter rods comprised of crimped and bundled paper confined by an enclosing paper wrapper were utilized as the precursor cellulose rod. The filter rods, supplied by the Ecusta Paper Co., Pisgah Forest, NC, were designated as product code High Bulk - TOD 06481 and had a circumference of 25.1 mm, length of 36" and pressure drop characteristic of 1" water per 25 mm filter length. The rods have an open pore volume of about 86.6% of the total volume of the rod.

The filter rods were placed in close-fitting glass tubes. Water was thereby passed through each rod in order to remove additives that may have been utilized in fabricating the filter rods. Aqueous solutions containing additives such as $Na_2B_4O_7$, $CaCl_2$ or $K_4Fe(CN)_6$ at a 1% concentration were passed through the filter rods, excess solution being removed by vacuum aspiration. The rods were dried while still within the confining tubes and were then removed from said tubes. The amount of additive deposited by said treatment was about 1.8% based upon the total weight of the treated rod. The outer wrap was removed from the rods and said rods nevertheless retained their circular shape.

The rods thus prepared were fed continuously, one abutting another in end-to-end relationship, into a heated die contained within a chamber confining a stream of nitrogen gas. The die had a funnel shaped entrance, followed by a cylindrical bore having a diameter of 7 mm and length of 3". The die was electrically heated to a temperature of 800° C. The cellulose filter rods were fed into and removed from the die at a rate such that the residence time within the heated die was 17 seconds. The carbonized rod emerging from the die has a circular diameter of 6.3 mm. The linear contraction due to carbonization was about 10%. Data concerning weight loss due to carbonization, pore volume, and rod strength are recorded in the table below for the different additives and for a control filter rod having no pyrolysis-controlling additive.

| Sample | Additive | % Weight Loss | % Pore Volume | Strength (g)* |
|---|---|---|---|---|
| A | $K_4Fe(CN)_6$ | 69 | 92.5 | 87 |
| B | $Na_2B_4O_7$ | 80 | 95.2 | 75 |
| C | $CaCl_2$ | 85 | 96.3 | 35 |
| D | None | 90 | 98.5 | 2 |

*Length of test specimen = 36.5 mm.

The data indicate that, when the weight loss exceeds 85%, there is a serious loss in strength of the carbon rod.

The additives, because of their effectiveness in minimizing weight loss, produce carbon rods of improved strength. The data further suggest that the percent of pore volume also appears to be generally related to weight loss. Pore volumes above 98.5%, although potentially desirable for smoking considerations, are associated with unsatisfactorily low rod strength.

The process aspects of this example exemplify the possibility of fabricating the carbonized cores on a continuous basis. This would be achieved by forming and pretreating the cellulose precursor rod at a linear rate equal to the linear rate of carbonization. It should be noted, however, that the carbonization transformation may be accomplished in two or more sequential steps instead of the single stage transformation of this example.

Carbon cores A, B, C and D were utilized for the fabrication of handmade cigarettes. It was found that core D was generally too weak to be handled without breaking. Cores A, B and C produced cigarettes having a normal burn rate, acceptable coal characteristics, and satisfactory taste qualities. Cores A, B and C could be cleanly cut to desired lengths with a razor blade.

Microscopic examination of the carbon core reveals retention of the general fibrillar configuration of the precursor cellulosic rod with the exception that some of the extremely fine fibrous appendages of the paper pulp particles are missing. There is also in evidence carbonized material which appears to bond the fibrous elements together. Such bonding material is thought to derive from the tar-like pyrolyzate generated during pyrolysis. Because of the particular apparatus and process utilized, the pyrolyzate is permitted to condense on the fibers in cooler regions of the rod upstream from the heated die. The condensed pyrolyzate then undergoes carbonization to form rigid bridging between fibers. The self-generated or autogenous carbonized bonding material improves the structural integrity of the core, and increases its flexural strength.

What is claimed is:

1. A smoking article comprising a gas permeable, self-supporting central core separately circumscribed by tobacco, said core consisting essentially of carbonized fibers having a diameter below 0.2 mm.

2. The article claimed in claim 1 wherein said core is comprised of pyrolyzed multi-filament cellulosic strand.

3. The article of claim 2 wherein said cellulosic strand is a bundled structure comprised of gathered, essentially isotropic web selected from the group consisting of paper, fabric and non-woven fabric.

4. The article of claim 3 wherein said central core possesses an internal fiber structure generally similar to the internal fiber structure of said cellulosic strand and is composed of at least 80% carbon.

5. The article of claim 4 wherein said central core possesses an open pore volume in the absence of noncarbonaceous additives of between 85% and 97%, said central core having an absolute breaking strength greater than 4 grams.

6. The article of claim 5 wherein said carbonized fibers are interbonded in part by the carbonization of material produced by the condensation of volatile decomposition products of said cellulosic strand.

7. The article of claim 1 wherein said core contains inorganic additives to control its burning characteristics.

8. A method of making a smoking product comprising the steps of forming cellulosic fibrous matter into rod configuration, carbonizing said fibrous matter and thereafter circumscribing such carbonized rod with tobacco.

9. The method claimed in claim 8 including the preliminary step of preselecting as said fibrous matter a strand consisting essentially of cellulosic fibers having a diameter below 0.2 mm.

10. The method claimed in claim 9 wherein said carbonizing step is practiced by pyrolyzing said cellulosic strand.

11. The method claimed in claim 9 wherein said forming and carbonizing step is practiced by drawing said cellulosic strand through a die heated to pyrolyzing temperature.

12. The method claimed in claim 11 wherein said pyrolyzing temperature is in the range of about 600°–1000° C. and the duration of said carbonizing step is between about 1 and 45 seconds.

13. The method claimed in claim 9 wherein said preselecting step is practiced by selection of essentially isotropic web from the group consisting of paper, fabric and non-woven fabric.

14. The method claimed in claim 9 wherein said pyrolysis is achieved within a substantially non-oxidizing environment in a manner to cause said cellulosic rod to be transformed into a self-supporting carbon rod whereby a weight loss in the range of 60%–85% accompanies said transformation.

15. The method of claim 14 wherein the carbon rod has a higher percent of open pore volume than the cellulosic rod.

16. The method of claim 9 wherein said cellulose rod contains an additive which minimizes the amount of weight lost upon pyrolysis.

17. The method of claim 16 wherein said additive is a water soluble substantially non-volatile metal salt.

* * * * *